US011168269B2

(12) United States Patent
Koseoglu

(10) Patent No.: US 11,168,269 B2
(45) Date of Patent: Nov. 9, 2021

(54) PROCESS FOR PRODUCING DIESEL FUEL FROM OLEFINIC REFINERY FEEDSTREAMS

(71) Applicant: SAUDI ARABIAN OIL COMPANY, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/069,432

(22) Filed: Oct. 13, 2020

(65) Prior Publication Data

US 2021/0024836 A1 Jan. 28, 2021

Related U.S. Application Data

(62) Division of application No. 16/274,735, filed on Feb. 13, 2019, now Pat. No. 10,800,981.

(51) Int. Cl.
*C10G 61/02* (2006.01)

(52) U.S. Cl.
CPC ..... *C10G 61/02* (2013.01); *C10G 2300/1044* (2013.01); *C10G 2300/301* (2013.01); *C10G 2300/70* (2013.01); *C10G 2400/04* (2013.01)

(58) Field of Classification Search
None
See application file for complete search history.

(56) References Cited

U.S. PATENT DOCUMENTS

| | | | | |
|---|---|---|---|---|
| 10,053,401 | B1 | 8/2018 | Beadle et al. | |
| 2002/0144932 | A1* | 10/2002 | Gong | C10G 53/14 208/212 |
| 2005/0218038 | A1* | 10/2005 | Nero | C10G 27/12 208/208 R |

* cited by examiner

*Primary Examiner* — Derek N Mueller
(74) *Attorney, Agent, or Firm* — Abelman, Frayne and Schwab

(57) ABSTRACT

An integrated refinery process for producing diesel fuel blending stock from olefinic heavy naphtha streams that contain gasoline and compounds with carbon numbers in the range of from 9-14 are oxidized and converted into their corresponding oxides in the presence of a homogeneous or heterogeneous catalyst, or both, and optionally an acid phase transfer agent for the liquid reactants, the product oxides having boiling points about 34° C. higher than the corresponding olefins, and as a result, in the diesel blending component boiling point range. The oxygenates produced have lubricating properties that enhance the typically poor lubricity characteristics of ultra-low sulfur diesels and reduce the need for additives to improve the lubricity of the blended diesel fuels.

16 Claims, 2 Drawing Sheets

PROCESS FOR PRODUCING DIESEL FUEL FROM OLEFINIC REFINERY FEEDSTREAMS

CROSS REFERENCE TO RELATED APPLICATION

This application is a divisional application of application Ser. No. 16/274,735 filed Feb. 13, 2019, the contents of which are incorporated by reference in its entirety.

FIELD OF THE INVENTION

This disclosure is directed to a method for processing a refinery feedstream that contains olefinic compounds to produce components for blending diesel fuel.

BACKGROUND OF THE INVENTION

The worldwide demand for diesel fuel for automobile use has been increasing. Regulatory authorities have continued to mandate a reduction in the level of sulfur and nitrogen compound emissions, i.e., $SO_x$ and $NO_x$, in automotive exhaust gases. In order to maximize operational efficiencies, it is highly desirable for refineries to produce diesel blending stocks having higher cetane numbers.

A method for increasing the cetane number of diesel and biodiesel fuels by oxidation is described in WO 2014/041435 entitled "Method and Systems for Combined Oxidative and Hydrotreatment of Hydrocarbon Fuel". In one aspect of the disclosed process, a hydrocarbon diesel fuel feedstock is hydrotreated and then subjected to oxidative treatment to provide a product having a higher cetane number. In order to reduce the sulfur level in the hydrocarbon feedstock, the process includes a hydrotreating step for the purpose of reducing the content of sulfur- and nitrogen-containing compounds so that the treated stream meets regulatory standards and the upgraded liquid fuel can be introduced into a diesel blending pool. This hydrotreating step also hydrogenates the olefins present in the feedstock.

Following hydrotreating, the process includes a step of mixing the liquid hydrocarbon feedstock having an initial cetane number and an initial sulfur content with an aqueous oxidation source, an acid accelerator and a catalyst that comprises at least one metal selected from the group consisting of iron, nickel, vanadium and molybdenum. The mixing occurs in a cavitation reactor.

With the growing demand for high quality diesel fuels with low sulfur content and higher cetane numbers, the problem faced by refiners is how to selectively increase their production of diesel blending components.

SUMMARY OF THE INVENTION

The above problems are resolved and other advantages are provided by the present disclosure which is directed to an integrated refinery process for producing diesel fuel blending stock from olefinic heavy naphtha streams that contain gasoline in which the olefinic heavy naphtha stream containing compounds with carbon numbers in the range of from 9-14 are oxidized and converted into their corresponding oxides in the presence of a catalyst and, optionally an acid phase transfer agent for the liquid reactants. The resulting oxide products have higher boiling points than the corresponding olefins, i.e., about 34° C. higher, and with their higher boiling points are in the diesel boiling point range. These oxygen-containing hydrocarbons also have lubricating properties and as a result, the oxidized diesel blending components alleviate the poor lubricity characteristics of ultra-low sulfur diesels which require the use of additives to improve the lubricity of the blended diesel fuels. As a result of the oxidation, the boiling point of the feedstream shifts from the gasoline range to the diesel range, thus providing the refinery operator with an alternative process for quickly and easily meeting a demand for additional diesel blending components from one or more existing refinery feedstocks.

The feedstocks identified as being useful in the practice of the present process are cracked hydrocarbons containing olefins boiling in the range of 36° C. to 240° C. that can be catalytically oxidized. Particularly preferred are gasoline-containing products such as those from catalytic cracking processes such as fluid catalytic cracking (FCC) units, and from thermal cracking units, such as delayed coking, fluid coking and visbreaking units, and from conventional thermal cracking units.

A particularly suitable source of the feedstream to be treated in the present process are fluidized catalytic cracking (FCC) units which are widely used in the production of high octane gasoline to convert hydrocarbons boiling in the vacuum gas oil range, nominally from about 370° C. to 520° C., or residual hydrocarbons boiling above 520° C. The FCC product streams also contain the light gases C1-C4, gasoline, light cycle oil (LCO) and heavy cycle oil (HCO). The FCC gasoline is a mixture of hydrocarbons boiling in the range 36 to 240° C., the mixture comprising paraffins, aromatics, olefins and naphthenes, and it has a high octane number.

In order to facilitate the biphasic reaction, co-catalysts or phase transfer agents are employed to enhance and accelerate reactions which, though favored thermodynamically, are very slow due to mass transfer factors. They can be anionic, cationic and nonionic. In certain embodiments, cationic phase transfer agents are preferred. In the example described below, the optional acid phase transfer agent employed was acetic acid which is generally readily available and relatively inexpensive.

The present process can be practiced in a variety of reactors including fixed bed, ebullated bed, continuously stirred tank reactors (CSTR), slurry bed and moving bed reactors. An advantage of the process is its versatility, and the relatively wide range of conditions under which the catalyzed reaction can proceed, thereby providing the refinery operator with the flexibility of choosing from reactors that may be available at any given time within the battery limits of the refinery.

Both liquid and gaseous oxidants can be employed by the process. Oxidants that have been identified as suitable for use in the process include alkyl hydroperoxides, aryl hydroperoxides, dialkyl peroxides, and diaryl peroxides. The organic peroxides have the general formula:

$$R1\text{-}O\text{—}O\text{—}R2, \quad (1)$$

where R1 and R2 are the same or different alkyl groups or aryl groups. Also useful are peroxy acids of the general formula:

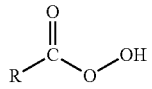

(2)

where R is an alkyl group.

The selection of other organic peroxides and hydroperoxides for use under specific predetermined operating conditions is within the skill in the art.

Suitable gaseous oxidants include oxygen, air, and oxides of nitrogen, including nitrous oxide.

Both homogeneous oil soluble catalysts and heterogeneous solid catalysts that include at least one metal selected from IUPAC Groups 4-10 of the Periodic Table can be used. Homogeneous or heterogeneous catalysts containing Mn, Co, Fe, Cr Ni, Ti, Zr, W, V and Mo are preferred. Examples of suitable oxidation catalyst compounds include molybdenum hexacarbonyl, molybdenum acetylacetone, $MoO_3$, $Fe_2O_3$, $V_2O_5$, $ZrO_2$, $TiO_2$. In additional embodiments, the oxidative reaction catalyst includes salts of transition metal oxides, wherein salts are selected from IUPAC Groups 1 and 2 of the Periodic Table such as $Na^+$, $K^+$, $Ca^{++}$, $Mg^{++}$, or mixtures thereof, including but not limited to sodium tungstate.

The selection of the type of catalyst, i.e., homogeneous or heterogeneous, and the oxidant, liquid or gas, as well as the type of reactor is within the skill in the art. The choice can be based on the availability of the equipment within the battery limits of the refinery, as well as the catalysts and acid phase transfer agents, or accelerators, that may be available for use are used in other unrelated refinery processes.

BRIEF DESCRIPTION OF THE DRAWINGS

The current process will be described in further detail below and with reference to the drawings that follow in which the same numerals are used to refer to the same and similar elements, and where.

DETAILED DESCRIPTION OF THE INVENTION

Figure 1:
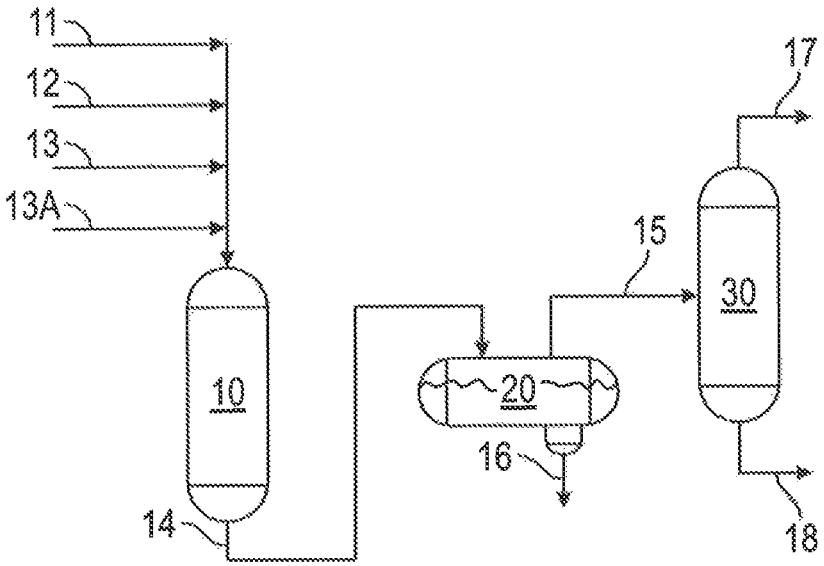
FIG. 1 is a simplified schematic diagram of an embodiment of the oxidation process utilizing a homogeneous catalyst.

Referring now to FIG. 1, a process in accordance with the present disclosure is illustrated in which a feedstock from a source (11) such as described above containing cracked gasoline, and a liquid oxidant (12) are added to a two-phase oxidation reactor (10). One or more solubilized homogeneous catalysts (13) and, optionally, an acid phase transfer agent (13A) are introduced into the oxidation reactor (10) where they are thoroughly mixed for a time that is sufficient for the olefins present in the cracked gasoline (11) to be catalytically oxidized into their respective oxide forms.

The mixing is continued in oxidation reactor (10) for a predetermined period of time and under conditions that will permit the oxidation of all, or substantially all, of the olefinic compounds present in the feedstock (11). Suitable operating conditions for the homogeneously catalyzed oxidation reactions employing liquid oxidants are temperatures in the range of from 20° C. to 100° C., preferably from 20° C. to 80° C., and most preferably from 20° C. to 60° C., and a pressure of from 1 bars to 10 bars, preferably from 1 to 5 bars, and most preferably from 1 to 3 bars.

The reaction mixture is then passed to a two-phase liquid-liquid separator (20) for separation of the water from the hydrocarbons. As illustrated, the aqueous phase settles and is withdrawn as aqueous stream (16). The hydrocarbons are passed from the liquid-liquid separator (20) as treated hydrocarbon stream (15) and introduced into a separation zone (30). The separation zone (30) can include a stripper, a fractionator or a flash unit, or a combination of two or more of these devices.

The lighter gasoline blending components (17) boiling in the range of 36° C. to 180° C. are removed from the upper portion of the separation zone (30) and the heavier diesel blending components (18) boiling in the range of from 180° C. to 370° C. are removed from the lower portion of the separation zone (30). The separated components are sent, respectively, to the gasoline blending pool and the diesel blending pool.

Referring now to the simplified schematic diagram of FIG. 2, a process in accordance with the present disclosure employing one or more heterogeneous catalysts will be described. The solid catalyst (13) is preloaded into the two-phase oxidation reactor (100) and the cracked gasoline feedstock (11), a liquid oxidant (12) and, optionally, an acid phase transfer agent (13A) are introduced into the top of the oxidation reactor and, as illustrated, flow downwardly through the solid catalyst (13) at a predetermined rate that is sufficient to effect the oxidation of all, or substantially all of the olefinic compounds while in the reactor (100).

Figure 2:
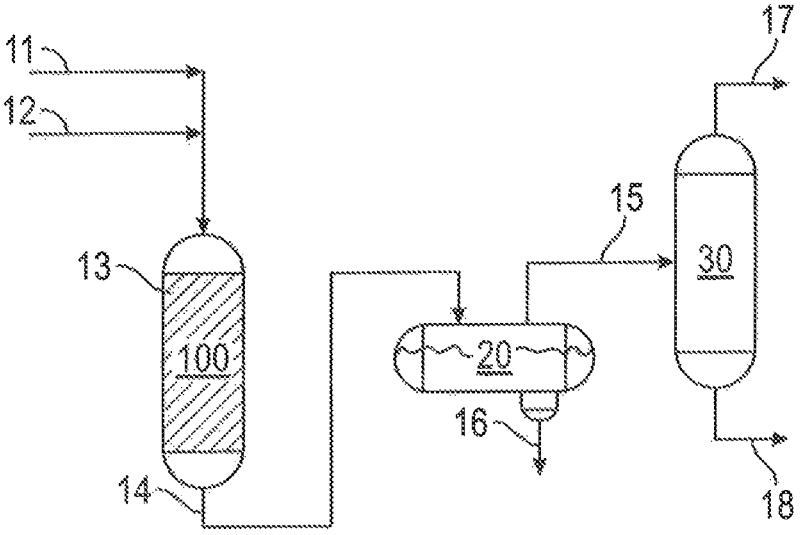
FIG. 2 is a simplified schematic diagram of another embodiment of the process utilizing a heterogeneous catalyst.

As will be understood by one of ordinary skill in the art, the downstream processing steps in FIG. 2 of the hydrocarbon stream containing the reaction products and water are the same as those described above in connection with FIG. 1.

When one or more gas phase oxidants are used, the gaseous oxidants are introduced into a gas distribution reactor (not shown) in place of reactor (10) in which the gas is intimately contacted with the liquid mixture in the form of small bubbles and preferably as micro bubbles. The liquid-liquid separation vessel (20) is replaced with a gas-liquid separation vessel and any remaining oxidant gases separated are recycled back to the oxidation reactor (10).

Suitable operating conditions for the heterogeneously catalyzed oxidation reactions in the solid catalyst-containing reactor (100) using liquid oxidants are a temperature in the range of from 20° C. to 100° C. and a pressure in the range of from one bar to 30 bars.

The oxidation agents can be added directly to the catalytic reactor or formed in situ in accordance with methods known in the art, such as in the in situ formation of organic peroxides, e.g., as disclosed in US 2013 026062, the disclosure of which is incorporated in its entirety by reference. For example, the in situ generation of an organic peroxide, or peroxides, can be conducted in an apparatus that includes an inlet for receiving an olefinic heavy naphtha hydrocarbon stream, a gas inlet for receiving a gaseous oxidant stream, and an oxidant outlet for discharging an effluent that can include the organic peroxide and any unreacted, unconverted or partially converted hydrocarbons and heteroatom-containing hydrocarbons including organosulfur and organonitrogen compounds. The organic peroxide generating apparatus contains a quantity of heterogeneous catalyst material that is effective to promote the generation of the organic peroxide. In an alternative embodiment, in combination with the heterogeneous catalyst, the apparatus can also include an inlet for receiving another stream that contains a concentration of a homogeneous catalyst in a liquid stream that is also effective to promote the generation of the organic peroxide. In a further embodiment (not shown), only the homogeneous catalyst is employed to promote the generation of the organic peroxide.

In alternative processes (not shown), the gaseous oxidant and/or homogeneous catalyst can be mixed with the olefinic-rich stream, and the combined feed is charged to the organic peroxide generation apparatus.

In a further alternative process (not shown), a mixer can be provided in a vessel upstream of the peroxide generation apparatus in which gaseous oxidant, the olefinic-rich fraction and homogeneous catalyst are admixed prior to being introduced into the organic peroxide generation apparatus.

EXAMPLE

In a laboratory-scale example, a sample of 20 g of FCC naphtha was oxidized in a vessel containing using 0.3 g of sodium tungstate ($Na_2WO_4.2H_2O$) in aqueous solution, 1.3 grams of acetic acid and 24 grams of hydrogen peroxide. The mixture was stirred in a round bottom flask and reacted for 60 minutes at 20° C. The reaction mixture was maintained at a reflux condition to prevent any vapor release from the system. At the end of sixty minutes, the reflux was stopped and the hydrocarbon phase was separated from the aqueous phase.

Figure 3:
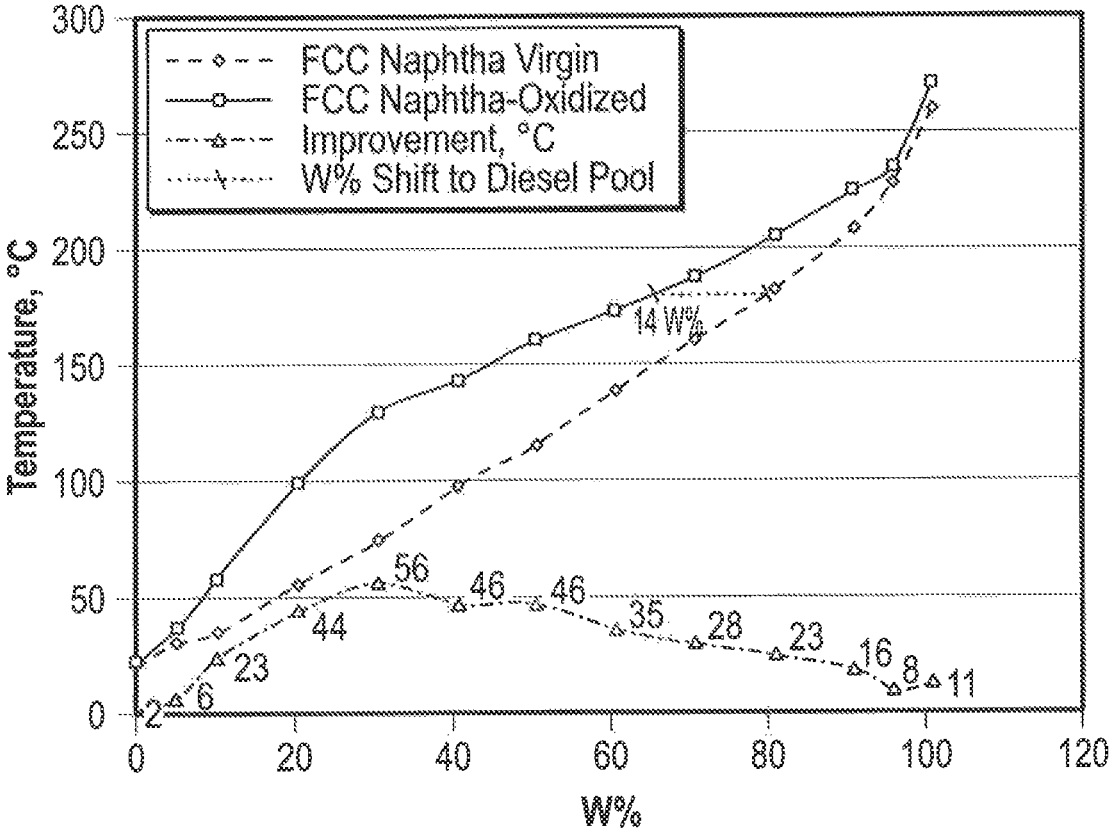
FIG. 3 is the plot of a simulated distillation curve for a feedstock and the oxidized products of the feedstock.

The feedstock and product were analyzed by simulated distillation in accordance with ASTM D2887 and the results are presented in the diagrammatic plot of FIG. 3. As shown, the uppermost line is a plot of the FCC naphtha stream following the catalytic oxidation reaction and the line immediately below is a plot of the original boiling points of the untreated FCC naphtha stream. The bottom line is an independent plot along the X-axis of the increase in the boiling point temperatures between the untreated FCC naphtha and the oxidized FCC naphtha product stream, where the numerical values represent the increase in boiling point in degrees centigrade at the respective data points. At any given point along the respective plot lines, the horizontal distance between the plots of the FCC naphtha oxidized and untreated streams corresponds to the percentage of the weight shift from the gasoline to the diesel range blending components in the respective streams.

As shown by the plots of FIG. 3, there is clear shift in boiling point, with 14 W % of the gasoline boiling range material shifted to diesel boiling range components. Thus, the problem of satisfying the increasing demand for middle distillate fuel is addressed by the present invention which shifts the gasoline range products to the distillate fuel, or diesel range, thereby increasing the production of distillate fuels.

The FCC naphtha gasoline and the oxidized hydrocarbon product were subjected to PIONA analyses for paraffins (n-P), isoparaffins (i-P), olefins (O), naphthenes (N) and aromatics (A), and the results are reported in Table 1 and Table 2, respectively. As can be seen, the olefin content was reduced from 31.5 W % to 18.5 W % which indicated the extent of the oxidation reactions.

TABLE 1

PIONA Analysis of FCC Gasoline

| C# | n-P | i-P | O | N | A | Total |
|---|---|---|---|---|---|---|
| 4 | 1.0 | 0.6 | 1.4 | 0.0 | 0.0 | 3.0 |
| 5 | 0.8 | 5.2 | 8.5 | 0.1 | 0.0 | 14.6 |
| 6 | 0.6 | 5.3 | 6.0 | 1.3 | 0.8 | 14.0 |
| 7 | 0.7 | 4.2 | 6.4 | 2.2 | 2.1 | 15.6 |
| 8 | 0.8 | 3.9 | 2.4 | 2.5 | 5.1 | 14.8 |
| 9 | 0.3 | 2.7 | 1.0 | 1.3 | 6.1 | 11.3 |
| 10-14 | 1.0 | 5.0 | 5.7 | 1.1 | 14.0 | 26.8 |
| Total | 5.2 | 26.7 | 31.5 | 8.4 | 28.2 | 100.0 |

TABLE 2

PIONA Analysis of oxidized FCC Gasoline

| C# | n-P | i-P | O | N | A | Total |
|---|---|---|---|---|---|---|
| 4 | 0.0 | 0.0 | 0.0 | 0.0 | 0.0 | 0.0 |
| 5 | 0.0 | 0.0 | 0.0 | 0.0 | 0.0 | 0.0 |
| 6 | 0.0 | 0.0 | 0.2 | 0.0 | 0.0 | 0.2 |
| 7 | 0.0 | 0.0 | 0.2 | 0.1 | 0.6 | 0.9 |
| 8 | 0.7 | 1.5 | 1.5 | 1.5 | 7.3 | 12.5 |
| 9 | 0.5 | 3.7 | 2.1 | 2.0 | 13.5 | 21.9 |
| 10-14 | 2.4 | 11.4 | 14.4 | 2.2 | 34.1 | 64.5 |
| Total | 3.6 | 16.6 | 18.3 | 5.8 | 55.6 | 100.0 |

As will be understood from the above, the catalyzed oxidation of an olefinic heavy naphtha refinery stream in accordance with the present process shifts the boiling point of the feedstream from the gasoline range to the diesel range and permits the refinery operator to relatively quickly and efficiently change the slate in order to meet an increase in the market demand for diesel fuel. An additional benefit realized from the oxygen-containing diesel blending components produced by this process are the lubricating properties of these oxygenates, which result in the reduction or elimination of the need for lubricity additives in the final blend of the diesel fuel products.

Although the present invention has been described with reference to various examples and embodiments, other modifications and variations will be apparent to those of ordinary skill in the art from the above description, and the scope of protection for the invention is to be determined by the claims that follow.

The invention claimed is:

1. An integrated refinery process for producing diesel fuel blending components, the process comprising:

a. contacting an olefinic heavy naphtha hydrocarbon feedstock with a gaseous oxidant and an oxidation catalyst in an oxidation reactor for a predetermined period of time that is sufficient to oxidize all or substantially all of the olefinic compounds in the feedstock to form their oxides;

b. passing the liquid reaction mixture and any unreacted gaseous oxidant to a separation zone and separating any gaseous oxidant and an aqueous phase to form a hydrocarbon reaction mixture and discharging the gaseous oxidant and aqueous phase;

c. recovering and passing the hydrocarbon reaction mixture to a hydrocarbon separation zone and separating gasoline range blending components from diesel range blending components based on their respective boiling point ranges; and d. recovering the diesel range blending components.

2. The process of claim of claim 1 in which the feedstock is derived from a catalytic cracking unit or a thermal cracking unit.

3. The process of claim 2 in which the catalytic cracking unit is a fluidized catalytic cracking (FCC) unit.

4. The process of claim 2 in which the olefinic heavy naphtha hydrocarbon feedstock includes gasoline.

5. The process of claim 2 in which the FCC gasoline is a mixture of hydrocarbons comprising paraffins, aromatics, olefins and naphthenes boiling in the range from 36 to 240° C.

6. The process of claim 2 in which the thermal cracking unit is a delayed coking unit.

7. The process of claim 1 in which the oxidant is selected from the group consisting of oxygen, air, oxides of nitrogen, and mixtures thereof.

8. The process of claim 1 in which the oxidation catalyst is an oil soluble homogeneous catalyst selected from the group consisting of sodium tungstate, molybdenum acetylacetone and molybdenum hexacarbonyl.

9. The process of claim 1 in which the oxidation catalyst is selected from the group consisting of MoO3, Fe2O3, V2O5, ZrO2, TiO2.

10. The process of claim 1 in which the oxidation catalyst includes salts of transition metal oxides, wherein the salts are selected from IUPAC Groups 1 and 2 of the Periodic Table and includes Na+, K+, Ca++, Mg++, or mixtures thereof.

11. The process of claim 1 in which the oxidation reactor is a fixed bed catalytic reactor and the hydrocarbon feedstock is introduced into the top of the catalyst bed and the oxidant is introduced into the bottom of the reactor for contact in counter-current flow with the feedstock, and the oxidized reaction products and any partially converted or unconverted feedstock is recovered from the bottom of the reactor.

12. The process of claim 1 in which the oxidation catalyst comprises a support and a metal selected from the group consisting of IUPAC Groups 4-10 of the Periodic Table.

13. The process of claim 1 in which the reaction is conducted in a three-phase reactor selected from the group consisting of fixed bed, ebullated bed, slurry bed and moving bed reactors.

14. The process of claim 1 in which the oxides formed by the catalytic oxidation of the olefins are oxygenates.

15. The process of claim 14 in which oxygenates are formed in the reaction mixture that increase the lubricity of the diesel fuel blending components.

16. The process of claim 1 in which the oxides formed by the catalytic oxidation of the oxygenates are epoxides of the olefins.

* * * * *